US006201535B1

(12) United States Patent
Hwang

(10) Patent No.: US 6,201,535 B1
(45) Date of Patent: Mar. 13, 2001

(54) FLAT PANEL DISPLAY APPARATUS WITH AUTOMATIC TRACKING CONTROL

(75) Inventor: Ho-Dae Hwang, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/246,133

(22) Filed: Feb. 8, 1999

(30) Foreign Application Priority Data

Feb. 6, 1998 (KR) ..... 98-03511

(51) Int. Cl.[7] ..... G09G 5/00; G09G 3/36
(52) U.S. Cl. ..... 345/213; 345/211; 345/98
(58) Field of Search ..... 345/311–312, 98

(56) References Cited

U.S. PATENT DOCUMENTS

| | | | |
|---|---|---|---|
| 4,323,924 | 4/1982 | Flasza | 348/726 |
| 4,483,599 | 11/1984 | MacRae et al. | 352/22 |
| 4,491,925 | 1/1985 | Richards | 345/17 |
| 5,021,719 | 6/1991 | Arai et al. | 315/364 |
| 5,155,417 | 10/1992 | Tateishi | 315/371 |
| 5,333,019 | 7/1994 | Okamoto | 348/656 |
| 5,748,252 | 5/1998 | Draves | 348/516 |
| 5,966,111 * | 10/1999 | Koshoubu et al. | 345/94 |
| 6,014,177 * | 1/2000 | Nozawa | 348/540 |
| 6,043,803 * | 3/2000 | Shimizu | 345/213 |

* cited by examiner

*Primary Examiner*—Richard A. Hjerpe
*Assistant Examiner*—Duc Q. Dinh
(74) *Attorney, Agent, or Firm*—Robert E. Bushnell, Esq.

(57) ABSTRACT

A flat panel display apparatus includes a sampling clock generator for generating a sampling clock signal with a frequency corresponding to a synchronous signal supplied from a host, a delay circuit for delaying the sampling clock signal, a level converter for converting an analog video signal supplied from the host to have a given digital voltage level, a phase detector for detecting the phase difference between the digital voltage level video signal from the level converter and the sampling clock signal delayed by the delay circuit to generate a phase difference data, a comparator for comparing the phase difference data with a delay data corresponding to the synchronous signal, a micro-controller for generating the delay data to increase or decrease the delay time of the delay circuit to adjust the phase of the sampling clock signal in response to the output of the comparator, and an analog to digital converter for converting the analog video signal into corresponding digital video signal in response to the delayed sampling clock signal.

20 Claims, 6 Drawing Sheets

FLAT PANEL DISPLAY APPARATUS WITH AUTOMATIC TRACKING CONTROL

CLAIM OF PRIORITY

This application makes reference to, incorporates the same herein, and claims all benefits accruing under 35 U.S.C. §119 from an application for FLAT PANEL DISPLAY APPARATUS HAVING AUTO TRACKING CONTROL FUNCTION earlier filed in the Korean Industrial Property Office on the $6^{th}$ day of February 1998 and there duly assigned Ser. No. 03511/1998, a copy of which is annexed hereto.

BACKGROUND OF THE INVENTION

1. Technical Field

The present invention concerns a flat panel display apparatus, and more particularly a flat panel display apparatus with an automatic tracking control.

2. Related Art

The flat panel display apparatus receives an analog video signal and synchronous signal from a host such as a computer system. Then the flat panel display apparatus uses an analog to digital converter (A/D converter) to convert the analog video signal to corresponding digital video signal to display. In this case, the sampling clock signal supplied to the A/D converter varies in its frequency depending on the characteristics of the synchronous signal.

Computer systems are information handling systems that are utilized by many individuals and businesses today. A computer system can be defined as a microcomputer that includes a central processing unit (CPU), a volatile memory, a non-volatile memory such as read only memory (ROM), a display monitor, a keyboard, a mouse or other input device such as a trackball, a floppy diskette drive, a compact disc-read only memory (CD-ROM) drive, a modem, a hard disk storage device, and a printer. A computer system's main board, which is a printed circuit board known as a motherboard, is used to electrically connect these components together. A computer system can be a desktop computer, a portable computer such as a notebook computer or palm-sized computer, or other type of computer. The central processing unit is often described as a microprocessor. The microprocessor is an electronic component having internal logic circuitry handling most, if not all, the data processing in the computer system. The internal logic circuitry of microprocessors is typically divided into three functional parts known as the input/output (I/O) unit, the control unit, and the arithmetic-logic unit (ALU). These three functional parts interact together and determine the power and performance of the microprocessor. The combination of the control unit and the arithmetic-logic unit can be referred to as the central processing unit. Also, the combination of the input/output unit, the control unit, and the arithmetic-logic unit can be referred to as the central processing unit. One example of non-volatile memory is read only memory (ROM). Information stored in non-volatile memory can remain unchanged even when there is a power failure. The information stored in non-volatile memory will stay there until it is changed. Read only memory is used to store important information such as instructions for the central processing unit. There are different types of read only memory including electrically-erasable-programmable-read-only-memory (EEPROM) chip and flash-read-only-memory (flash-ROM). The flash-ROM can also be referred to as flash memory. Computer systems include a basic input output system (BIOS) which is an especially important program stored in read only memory. The basic input output system tests a computer every time the computer is powered on. The basic input output system can allocate a computer system's resources automatically, making adjustments needed to accommodate new hardware. Also, the basic input output system governs how system board components interact. When the computer system is powered on, the basic input output system immediately takes control of the computer system and its components. The first duty of the basic input output system is to perform a series of diagnostic routines called the power on self test (POST) routine, which ensures that every part of the computer system's hardware is functioning properly.

Meanwhile, the point at which the A/D converter performs a sampling on the analog video signal differs according to the phase of the sampling clock signal. Hence, when the sampling clock signal has a frequency suitable for the synchronous signal but with a phase difference, the proper sampling point is not secured, resulting in distorted video data and thus degradation of the picture quality. In order to resolve such problems, the flat display apparatus is provided with a tracking control, which is to adjust the phase of the sampling clock signal to achieve the optimum sampling point at which the effective parts of the analog signal may be sampled. This is also called the fine control, and has been manually preformed.

Such tracking control should be repeated whenever the display mode is changed, and it is very hard for a general user to manually perform the tracking adjustment control. Moreover, the manual control components can be so sensitive to factors such as heat that they may change a delay time and cause the analog video signal to be incorrectly converted into the digital video signal.

I have found that manual adjustments to tracking signals can be inconvenient and inefficient. Efforts have been made with reference to display devices, tracking signals, and synchronizing signals.

Exemplars of recent efforts in the art include U.S. Pat. No. 5,748,252 issued to Draves, U.S. Pat. No. 5,333,019 issued to Okamoto, U.S. Pat. No. 5,155,417 issued to Tateishi, U.S. Pat. No. 5,021,719 issued to Arai, et. at, U.S. Pat. No. 4,491,925 issued to Richards, U.S. Pat. No. 4,483,599 issued to MacRae, et. al, and U.S. Pat. No. 4,323,924 issued to Flasza.

While these recent efforts provide advantages, I note that they fail to adequately provide a flat panel display apparatus with automatic tracking control.

SUMMARY OF THE INVENTION

It is an object of the present invention to provide a flat panel display apparatus with means to automatically perform the tracking adjustment.

According to an embodiment of the present invention, a flat panel display apparatus comprises a sampling clock generator for generating a sampling clock signal with a frequency corresponding to a synchronous signal supplied from a host, a delay circuit for delaying the sampling clock signal, a level converter for converting an analog video signal supplied from the host to have a given digital voltage level, a phase detector for detecting the phase difference between the digital voltage level video signal from the level converter and the sampling clock signal delayed by the delay circuit to generate a phase difference data, a comparator for comparing the phase difference data with a delay data corresponding to the synchronous signal, a micro-controller for generating the delay data to increase or decrease the delay time of the delay circuit to adjust the phase of the sampling clock signal in response to the output of the comparator, and an analog to digital converter for converting the analog video signal into corresponding digital video signal in response to the delayed sampling clock signal.

Preferably, the delay circuit comprises a shift register for delaying the sampling clock signal according to a high frequency clock signal with a higher frequency than that of the sampling clock signal, and a multiplexer for selectively generating one of the outputs of the shift register under the control of the micro-controller. The level converter comprises a buffer for receiving the analog video signal, and a zener diode connected between the input of the buffer and ground. The phase detector comprises a counter for counting a clock signal with a higher frequency than that of the sampling clock signal, a latch for latching the output of the counter, and a flip-flop for enabling or disabling the counter and latch according as the level converter supplies the video signal or the delay circuit supplies the delayed sampling clock signal. There is further provided a high frequency clock generator for supplying a clock signal with a higher frequency than that of the sampling clock signal.

Thus, detecting the phase difference between the video signal and the sampling clock signal according to a high frequency clock signal, the delay time of the delay circuit is adjusted to obtain the proper phase of the sampling clock signal, thus making the A/D converter correctly convert the analog video signal to the digital video signal based on the correct sampling point.

To achieve these and other objects in accordance with the principles of the present invention, as embodied and broadly described, the present invention provides an apparatus, comprising: a video display conveying varying visual information to a user; a clock unit generating a first clock signal with a frequency corresponding to a synchronous signal received from a host; a delay circuit receiving said first clock signal from said clock unit, delaying said first clock signal by a quantity of time, and outputting a delayed clock signal; a first converter receiving an analog video signal from the host and outputting a voltage corresponding to said analog video signal; a detector unit receiving said voltage from said first converter unit and said delayed clock signal from said delay circuit, detecting a phase difference between said voltage and said delayed clock signal, and outputting phase difference data; a comparator receiving delay data corresponding to said synchronous signal, receiving said phase difference data, comparing said delay data and phase difference data, and outputting a comparison signal; a control unit receiving said synchronous signal from the host and said comparison signal from said comparator, outputting said delay data to said comparator, generating said delay data in response to said comparison signal in order to modify said quantity of time to adjust a phase of said first clock signal; and a second converter converting said analog video signal to a corresponding digital video signal in response to said delayed clock signal, and outputting said digital video signal to said video display, said digital video signal corresponding to the visual information.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENT

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
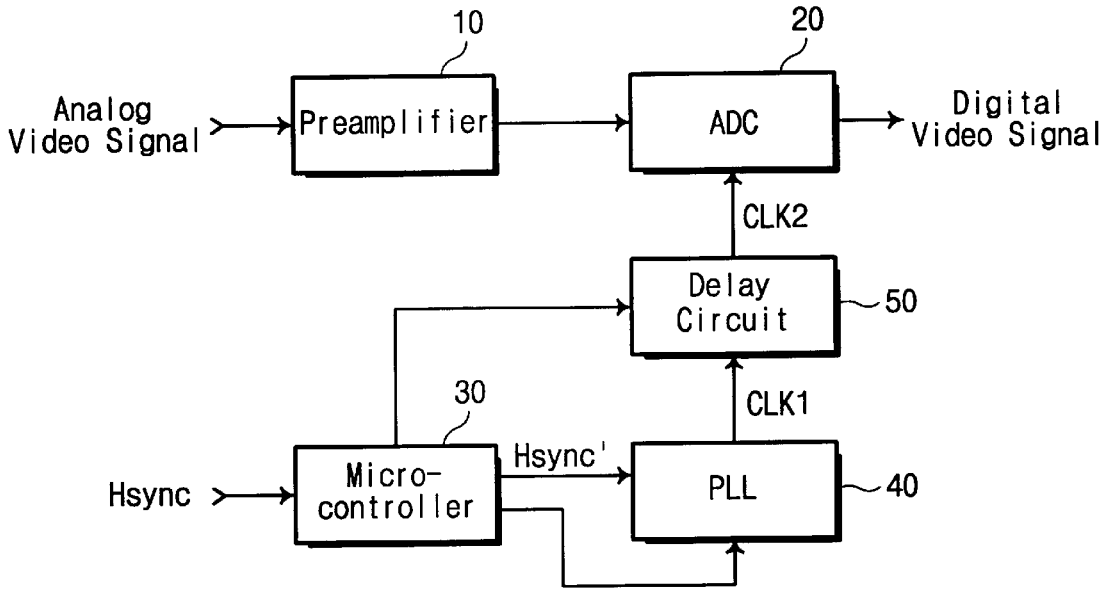
FIG. 1 is a block diagram for illustrating the circuit structure connected with the tracking control in a flat panel display apparatus.
Figure 2:
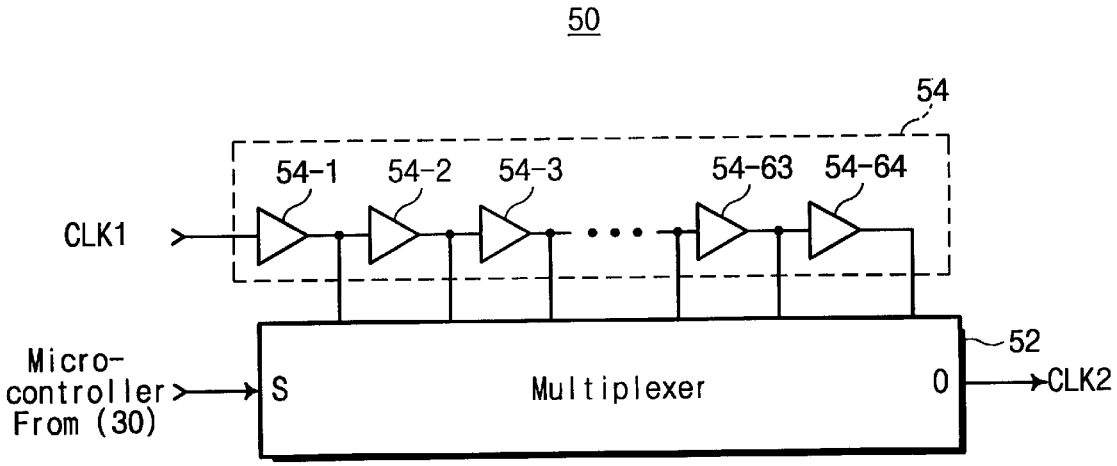
FIG. 2 is a detailed diagram of the delay circuit as shown in FIG. 1.

Describing tracking control with reference to FIGS. 1 and 2, the horizontal synchronous signal Hsync is delivered to a micro-controller 30, which generates a frequency divisional value corresponding to the present display mode to a sampling clock generator 40 consisting of phase locked loop (PLL), which in turn generates a sampling clock signal CLK1 with a frequency corresponding to the horizontal synchronous signal Hsync' and the frequency divisional value. The sampling clock signal CLK1 is delayed by a delay circuit 50 supplied to an A/D converter 20, which converts the analog video signal received from a host (not shown) and a preamplifier 10 to the corresponding digital video signal according to the delayed sampling clock signal CLK2. In response to a tracking adjustment signal inputted by the user, the micro-controller 30 controls the delay time of the delay circuit 50, which comprises a plurality of buffers 54-1 to 54-64 connected in series and a multiplexer 52 for selectively transferring the outputs of the buffers 54 according to a selective signal generated from the micro-controller 30.

Such tracking control should be repeated whenever the display mode is changed, and it is very hard for a general user to manually perform the tracking adjustment control. Moreover, the delay circuit 50 is so sensitive to factors such as heat that it may change the delay time to cause the analog video signal to be incorrectly converted into the digital video signal. The principles of the present invention solve these aforementioned problems. The principles of the present invention shall now be described in detail, below.

Figure 3:
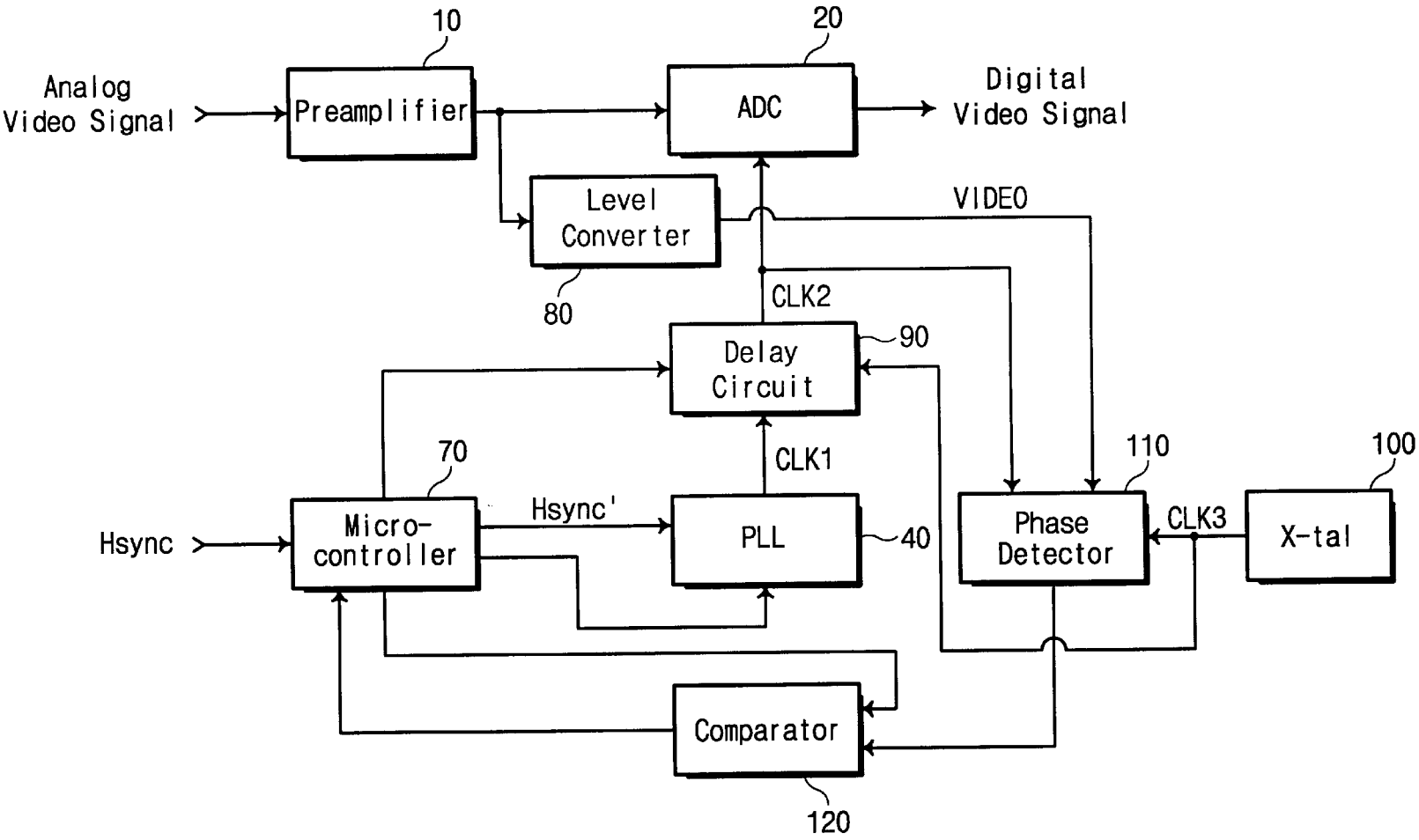
FIG. 3 is a block diagram for illustrating the circuit structure connected with an automatic tracking control in a flat panel display apparatus, in accordance with the principles of the present invention.

Referring to FIG. 3, a flat panel display apparatus comprises a preamplifier 10, A/D converter 20, delay circuit 90, sampling clock generator 40, and a micro-controller 70. There are further provided according to the present invention a level converter 80, high frequency generator 100, phase detector 110 and comparator 120. Receiving a horizontal synchronous signal Hsync from a host (not shown), the micro-controller 70 provides a frequency divisional value to the sampling clock generator 40 according to the present display mode. The sampling clock generator 40 generates a sampling clock signal CLK1 based on the frequency divisional value and horizontal synchronous signal Hsync' from the micro-controller 70. The sampling clock CLK1 is delayed by the delay circuit 90 supplied to the A/D converter 20, which converts an analog video signal from the host to a digital video signal in response to the delayed sampling clock signal.

Meanwhile, the analog video signal amplified by the preamplifier 10 is converted by the level converter 80 to a digital level (TTL level) applied to the phase detector 110.

Figure 4:
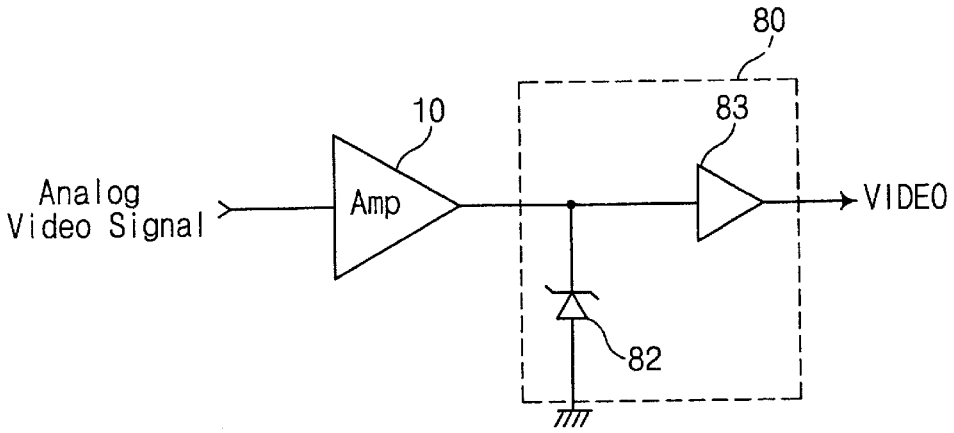
FIG. 4 is a detailed diagram of the level converter as shown in FIG. 3.

TTL represents transistor-transistor logic. In the TTL system, which is common inside computer equipment, a logical low is any voltage level below 0.8 volts and a logical high is any voltage level above 2.0 volts. The inventive automatic tracking control can be utilized with a TTL system but is not limited to the TTL system. In other words, the inventive automatic tracking control can be utilized with systems which are not TTL systems. The level converter 80 comprises a zener diode 82 and a buffer 83, as shown in FIG. 4. In addition, the delayed sampling clock signal CLK2 from the delay circuit 90 is delivered to the phase detector 110, which detects the phase difference between the two signals to generate a phase difference data applied to the comparator 120 according to a high frequency clock signal CLK3 supplied from the high frequency clock generator 100 consisting of a high frequency crystal oscillator. The high frequency clock signal CLK3 has a higher frequency than that of the sampling clock signal CLK1.

Figure 5:
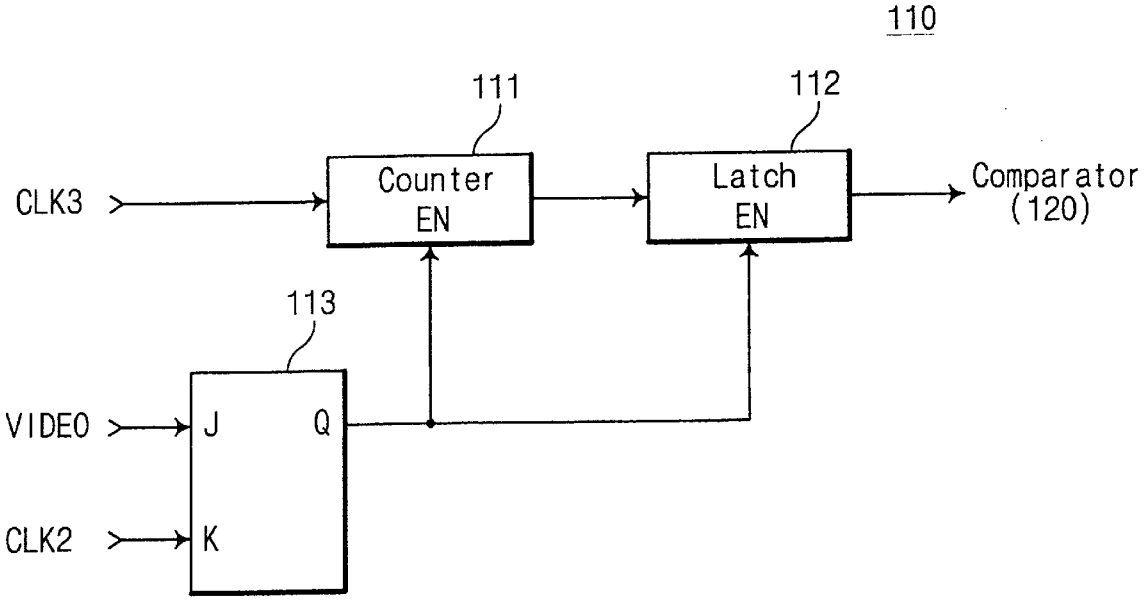
FIG. 5 is a block diagram for illustrating the structure of the phase detector as shown in FIG. 3.
Figure 6:
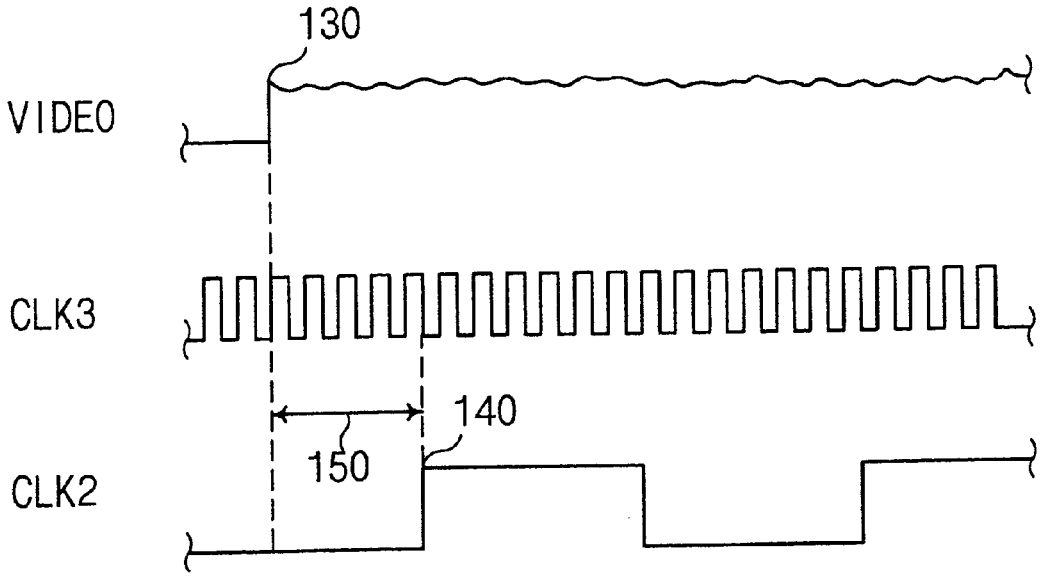
FIG. 6 is a waveform for illustrating the operation of detecting the phase difference between the video signal and the delayed sampling clock signal.

The phase detector 110 comprises, as shown in FIG. 5, a counter 111 for counting the high frequency clock signal CLK3, latch 112 for latching the output of the counter and a JK flip-flop 113 for enabling/disabling the latch 112. The JK flip-flop 113 works based on the horizontal synchronous signal Hsync' as the J-input and the sampling clock signal CLK1 as the K-input, as shown in FIG. 6. When the video signal converted to the digital level goes from low level to high level, as indicated by reference numeral 130 in FIG. 6, the J-K flip-flop 113 generates an enable signal to the counter 111 and latch 112. Then, the counter 111 begins to count the high frequency clock signal CLK3 supplied from the high frequency clock generator 100. The resultant data of the counter is latched by the latch 112. Subsequently, when the sampling clock signal CLK2 goes from low level to high level as indicated by reference numeral 140, the counter 111 stops the counting operation. As indicated by reference numeral 150, the resultant data (hereinafter referred to as 'phase difference data') of the counting operation represents the phase difference between the video signal and the sampling clock signal CLK2, latched by the latch 112.

Figure 7:
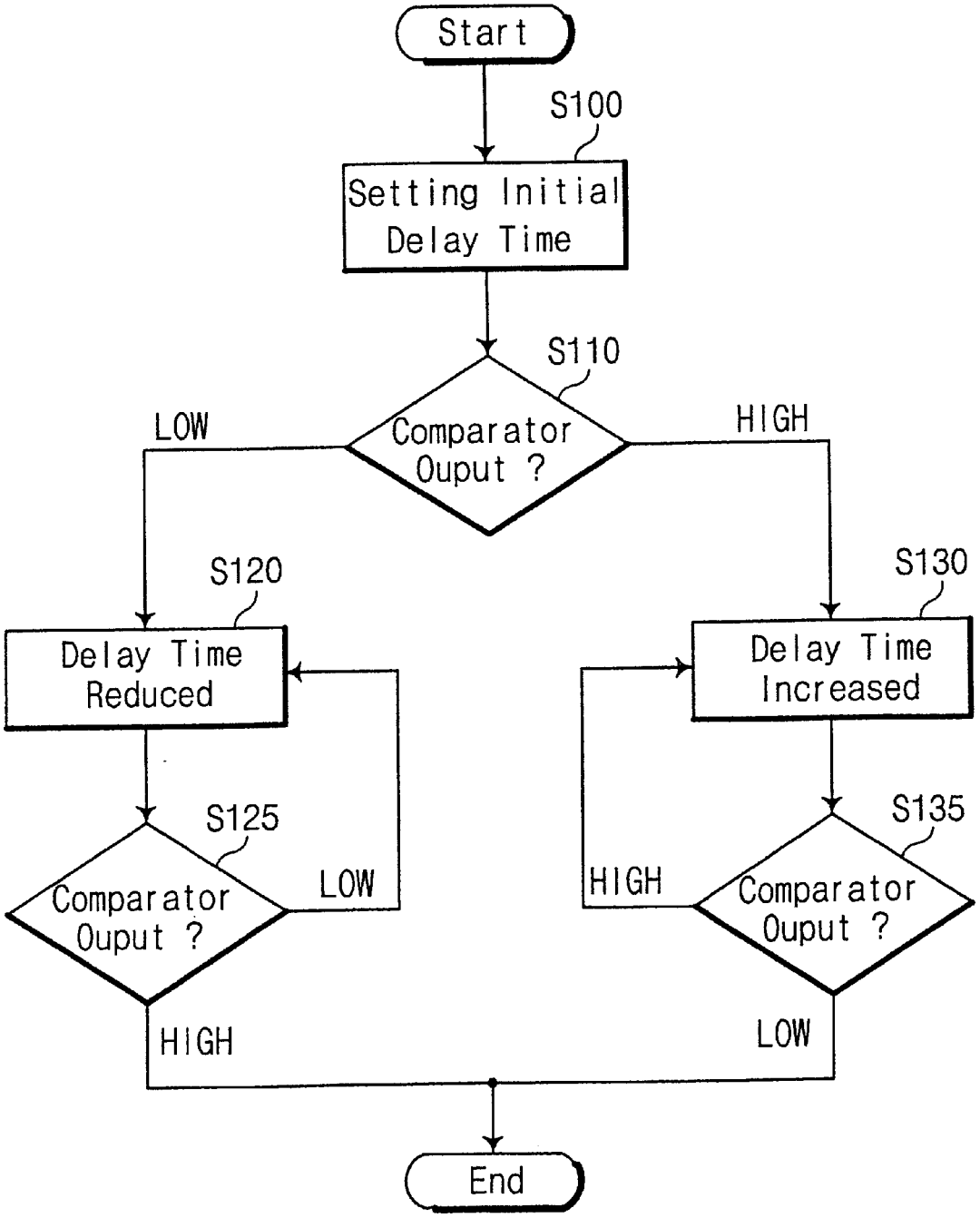
FIG. 7 is a flow chart for illustrating the control steps of the micro-controller as shown in FIG. 3.

Then, the phase difference data from the latch 112 is compared by the comparator 120 with a delay data from the micro-controller 70 to generate a control data. In response to the control data from the comparator, the micro-controller 70 increases or decreases the delay time of the delay circuit 90 to control the phase of the sampling clock signal, as shown in the flow chart of FIG. 7. At step S100, the micro-controller 70 sets the initial delay time. The delay circuit 90 delays the phase of the sampling clock signal from the sampling clock generator 40 by the initial delay time, supplying it to the A/D converter 20. The phase detector 110 and comparator 120 work as described above.

Figure 8:
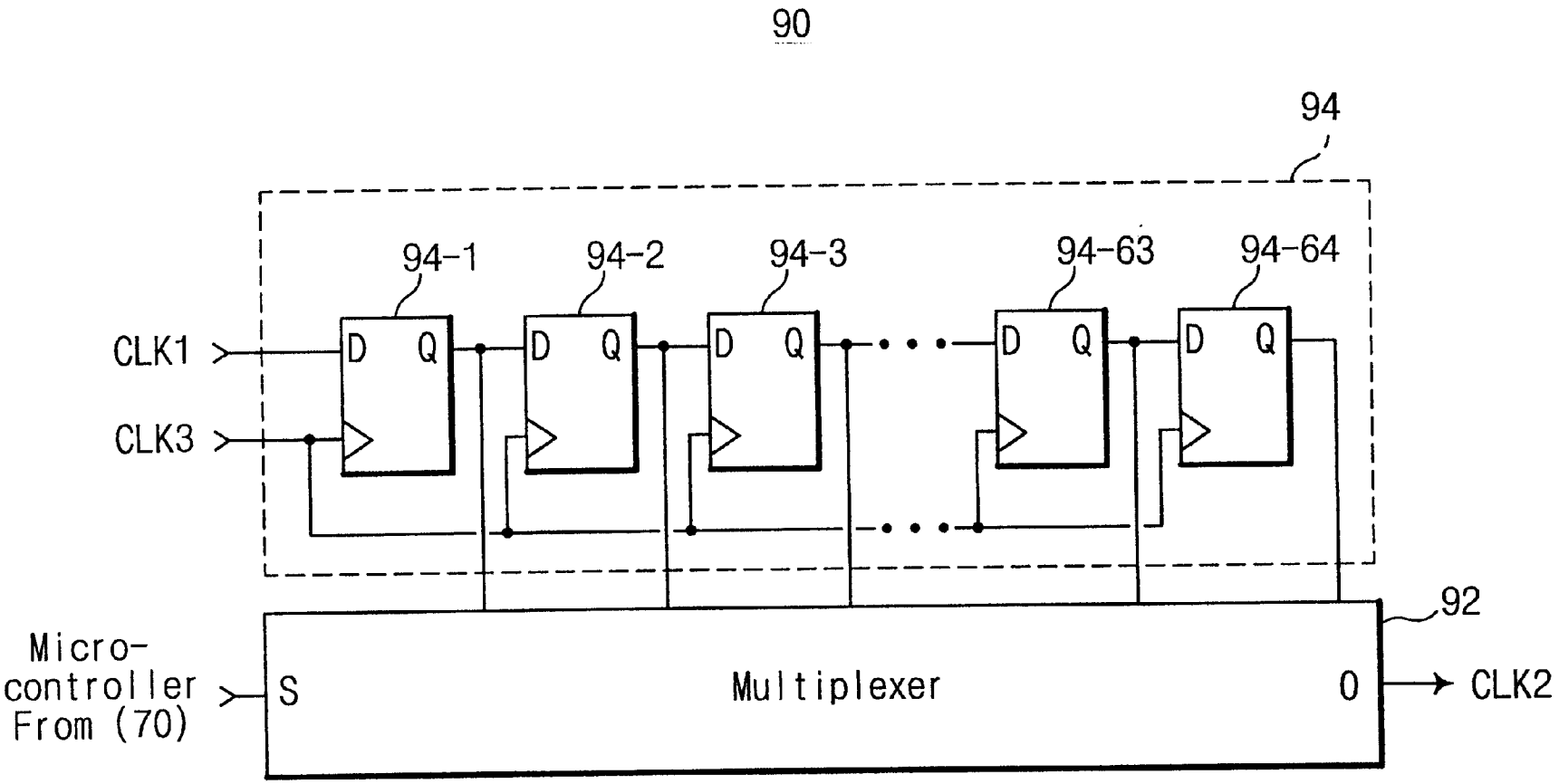
FIG. 8 is a detailed circuit diagram for illustrating the delay circuit as shown in FIG. 3.

At step S110, when the resultant compared value of the comparator 120 is found to be low, the process goes to step S120 to reduce the delay time by a unit time, and then to step S125. If the resultant compared value continues to be found low in step S125, the process returns to step S120. However, if the resultant compared value is found to be high in step S125, the automatic tracking control is ended. Alternatively, at step S110, if the resultant compared value is found to be high, the process goes to step S130 to increase the delay time by a unit time, and then to step S135. If the resultant compared value is found to be high in step S135, the process returns to step S130. Or otherwise, if it is found to be low, the process is ended. The delay circuit 90 comprises, as shown in FIG. 8, a shift register 94 consisting of a plurality of flip-flops 94-1 to 94-64, and a multiplexer 92.

Of course, the inventive automatic tracking control may be carried out by externally working a tracking adjustment key mounted on the flat panel display apparatus, or by automatic detection of the display mode.

The inventive automatic tracking control is not limited to one type of a display apparatus. For example, the inventive automatic tracking control can be utilized with a cathode ray tube, a liquid crystal display, a gas-plasma display, a light emitting diode display, an electro-luminescent display, a field emission display, and other types of display devices.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An apparatus, comprising:

a video display conveying varying visual information to a user;

a clock unit generating a first clock signal with a frequency corresponding to a synchronous signal received from a host;

a delay circuit receiving said first clock signal from said clock unit, delaying said first clock signal by a quantity of time, and outputting a delayed clock signal;

a first converter receiving an analog video signal from the host and outputting a voltage corresponding to said analog video signal;

a detector unit receiving said voltage from said first converter unit and said delayed clock signal from said delay circuit, detecting a phase difference between said voltage and said delayed clock signal, and outputting phase difference data;

a comparator receiving delay data corresponding to said synchronous signal, receiving said phase difference data, comparing said delay data and phase difference data, and outputting a comparison signal;

a control unit receiving said synchronous signal from the host and said comparison signal from said comparator, outputting said delay data to said comparator, generating said delay data in response to said comparison signal in order to modify said quantity of time to adjust a phase of said first clock signal; and a second converter converting said analog video signal to a corresponding digital video signal in response to said delayed clock signal, and outputting said digital video signal to said video display, said digital video signal corresponding to the visual information.

2. The apparatus of claim 1, said delay circuit further comprising:

a shift register having a plurality of output ports outputting a respective plurality of shifted output signals, said shift register delaying said first clock signal according to a second clock signal, said second clock signal having a higher frequency than said first clock signal; and a multiplexer receiving a control signal from said control unit, selecting one signal of said shifted output signals from among said plurality of shifted output signals in accordance with said control signal, and outputting said delayed clock signal corresponding to said one signal of said shifted output signals.

3. The apparatus of claim 1, said first converter further comprising:

a buffer having an input terminal and an output terminal, said input terminal receiving said analog video signal; and a zener diode having a first terminal and a second terminal, said first terminal being connected to said input Terminal of said buffer, said second terminal being connected to a local reference potential.

4. The apparatus of claim 1, said detector unit further comprising:

a counter having a first input terminal, a enabling input terminal, and an output terminal, said counter receiving a second clock signal at said first input terminal, said counter counting said second clock signal, said second clock signal having a higher frequency than said first clock signal;

a latch having a first input port, an enabling input port, and an output port, said latch latching output received at said first input port from said output terminal of said counter; and a flip-flop unit having a first input unit receiving said voltage from said first converter, a second input unit receiving said delayed clock signal from said delay circuit, and an output unit coupled with said enabling input terminal of said counter and said enabling input port of said latch, said flip-flop unit enabling said counter and latch in response to said voltage and delayed clock signal, and said flip-flop unit disabling said counter and latch in response to said voltage and delayed clock signal.

5. The apparatus of claim 2, further comprising a high frequency clock generator supplying said second clock signal.

6. The apparatus of claim 4, further comprising a high frequency clock generator supplying said second clock signal.

7. The apparatus of claim 1, said video display corresponding to on display selected from among a cathode ray tube, a liquid crystal display, a gas-plasma display, a light emitting diode display, an electro-luminescent display, and a field emission display.

8. The apparatus of claim 3, said first terminal of said zener diode corresponding to a cathode and said second terminal of said zener diode corresponding to an anode.

9. The apparatus of claim 1, said voltage output from said first converter corresponding to a voltage selected from among a high voltage and a low voltage.

10. The apparatus of claim 9, said high voltage corresponding to a voltage above 2.0 volts and said low voltage corresponding to a voltage below 0.8 volts.

11. A display apparatus, comprising:

a clock unit generating a first clock signal with a frequency corresponding to a synchronous signal received from a host;

a delay circuit receiving said first clock signal from said clock unit, delaying said first clock signal by a quantity of time, and outputting a delayed clock signal;

a first converter receiving an analog video signal from the host and outputting a voltage corresponding to said analog video signal;

a detector unit receiving said voltage from said first converter unit and said delayed clock signal from said delay circuit, detecting a phase difference between said voltage and said delayed clock signal, and outputting phase difference data;

a comparator receiving delay data corresponding to said synchronous signal, receiving said phase difference data, comparing said delay data and phase difference data, and outputting a comparison signal; and a control unit receiving said synchronous signal from the host and said comparison signal from said comparator, outputting said delay data to said comparator, generating said delay data in response to said comparison signal in order to modify said quantity of time to adjust a phase of said first clock signal.

12. The apparatus of claim 11, further comprising a second converter converting said analog video signal to a corresponding digital video signal in response to said delayed clock signal.

13. The apparatus of claim 11, said delay circuit further comprising:

a shift register having a plurality of output ports outputting a respective plurality of shifted output signals, said shift register delaying said first clock signal according to a second clock signal, said second clock signal having a higher frequency than said first clock signal; and multiplexer receiving a control signal from said control unit, selecting one signal of said shifted output signals from among said plurality of shifted output signals in accordance with said control signal, and outputting said delayed clock signal corresponding to said one signal of said shifted output signals.

14. The apparatus of claim 11, said first converter further comprising:

a buffer having an input terminal and an output terminal, said input terminal receiving said analog video signal; and a zener diode having a first terminal and a second terminal, said first terminal being connected to said input terminal of said buffer, said second terminal being connected to a local reference potential.

15. The apparatus of claim 11, said detector unit further comprising:

a counter having a first input terminal, a enabling input terminal, and an output terminal, said counter receiving a second clock signal at said first input terminal, said counter counting said second clock signal, said second clock signal having a higher frequency than said first clock signal;

a latch having a first input port, an enabling input port, and an output port, said latch latching output received at said first input port from said output terminal of said counter; and a flip-flop unit having a first input unit receiving said voltage from said first converter, a second input unit receiving said delayed clock signal from said delay circuit, and an output unit coupled with said enabling input terminal of said counter and said enabling input port of said latch, said flip-flop unit enabling said counter and latch in response to said voltage and delayed clock signal, and said flip-flop unit disabling said counter and latch in response to said voltage and delayed clock signal.

16. The apparatus of claim 13, further comprising a high frequency clock generator supplying said second clock signal.

17. The apparatus of claim 11, said voltage output from said first converter corresponding to a voltage selected from among a high voltage and a low voltage.

18. An apparatus, comprising:

a delay circuit receiving a first clock signal, delaying said first clock signal by a quantity of time, and outputting a delayed clock signal;

a first converter receiving an analog video signal from a host and outputting a voltage corresponding to said analog video signal;

a detector unit receiving said voltage from said first converter unit and said delayed clock signal from said delay circuit, detecting a phase difference between said voltage and said delayed clock signal, and outputting phase difference data;

a comparator receiving delay data corresponding to a synchronous signal, receiving said phase difference data, comparing said delay data and phase difference data, and outputting a comparison signal;

a control unit receiving said synchronous signal from the host and said comparison signal from said comparator, outputting said delay data to said comparator, generating said delay data in response to said comparison signal in order to modify said quantity of time to adjust a phase of said first clock signal; and a second converter converting said analog video signal to a corresponding digital video signal in response to said delayed clock signal.

19. The apparatus of claim 18, further comprising:

a video display conveying varying visual information to a user;

a clock unit generating said first clock signal with a frequency corresponding to said synchronous signal received from the host, said second converter outputting said digital video signal to said video display, and said digital video signal corresponding to the visual information.

20. The apparatus of claim 19, the host corresponding to a computer system.

* * * * *